US005259699A

United States Patent [19]

Klamar

[11] Patent Number: 5,259,699

[45] Date of Patent: Nov. 9, 1993

[54] PIPELINE PADDING SYSTEM

[76] Inventor: Edward J. Klamar, 320 N. 7th St., Indiana, Pa. 15701

[21] Appl. No.: 894,392

[22] Filed: Jun. 5, 1992

[51] Int. Cl.[5] ..... E02F 5/22; F16L 1/028

[52] U.S. Cl. ..... 405/179; 37/142.5; 209/235

[58] Field of Search ..... 405/154, 157, 179, 174, 405/180, 181; 37/142.5; 209/235, 241, 247

[56] References Cited

U.S. PATENT DOCUMENTS

| | | | |
|---|---|---|---|
| 4,038,828 | 8/1977 | Schuck et al. | 405/181 X |
| 4,861,461 | 8/1989 | Utterback . | |
| 4,955,756 | 9/1990 | Klamar . | |
| 5,120,433 | 6/1992 | Osadchuk | 209/235 |
| 5,195,260 | 3/1993 | Osadchuk | 37/142.5 |

*Primary Examiner*—David H. Corbin
*Attorney, Agent, or Firm*—Reed Smith Shaw & McClay

[57] ABSTRACT

A system for laying a trench bed layer consisting of fine grained material derived from unclassified fill material. The system includes a main frame that is pivotally supported by a hitch carried by a front end loader. The hitch includes a support bar that extends in the direction of travel of the front end loader whereby the main frame is securable to the support bar so as to extend transverse to the travel direction of the front end loader. Hydraulic cylinders normally used for manipulating the arms of the front end loader vary the attitude or angle of attack of the main frame in accordance with ground slope. The hitch also carries means for pivoting the main frame about a pin connection joining the main frame and the support bar. The system further includes a hopper carried by the main frame into which unclassified backfill material is loaded. A first conveyor transports the fill material from the bottom of the hopper to a vibrating screen. A second extendable and retractable conveyor is situated beneath the vibrating screen. The second conveyor is situated beneath the vibrating screen. The second conveyor receives only the fine particulate fraction of the original unclassified fill material which is sufficiently small to pass through the lower screen element and delivers this fine particulate fraction to the trench.

8 Claims, 13 Drawing Sheets

PIPELINE PADDING SYSTEM

FIELD OF THE INVENTION

The present invention relates in general to apparatus for backfilling a trench and, more particularly, to apparatus for laying a pipeline bed layer in a trench and for laying a pipeline bedding layer once a pipeline is laid in the trench.

BACKGROUND OF THE INVENTION

Apparatus for backfilling of trenches and for providing pipeline padding material are known in the art. An example of such apparatus is provided in U.S. Pat. No. 4,955,756 wherein the apparatus is suspended in cantilever fashion above the trench from a laterally projecting hitch mechanism secured to a crawler type tractor or the like which travels generally parallel to the trench.

More specifically, the apparatus described in U.S. Pat. No. 4,955,756 includes a main frame pivotally cantilevered on a hitch affixed to a side of a crawler tractor. The hitch extends transverse to the direction of travel of the tractor and the main frame is suspended thereby so as to extend parallel to the tractor travel direction. A hydraulic cylinder is provided to vary the attitude of the frame, that is, the relative angle or attack between the main frame and the hitch. The apparatus further includes a storage hopper carried by the main frame into which unclassified backfill material is loaded. The hopper mouth is typically provided with a grizzly which precludes large rock and oversize masses of clay fill from entering the hopper. An upwardly inclined, longitudinally extending conveyor transports the fill material from the bottom of the hopper to a higher elevation whereupon the fill is discharged from the conveyor and passes, preferably, through a comminuting or shredding station, onto a downwardly inclined, longitudinally extending vibrating screen. The speed of the conveyor and the attitude of the apparatus may be varied by an operator to maintain a substantially uniform flow of backfill onto the vibrating screen. The shredder mechanism is a rotary device which beats the fill material with flails, breaking up larger lumps into smaller lumps. The screen is double-decked in that it includes an upper and a lower screen element. Fine material of padding size falls through both screens into the trench and onto a previously laid pipe. Fill which fails to pass through the upper and/or lower screen elements travels over the screen elements into a chute and are directed rearwardly thereby into the trench and onto the padding fill.

Although suitable for its intended purposes, the apparatus disclosed in U.S. Pat. No. 4,955,756 requires the tractor to be fitted with a counterweight at the side thereof opposite the hitch to compensate for the imbalance created in the system by virtue of the cantilevered backfill apparatus.

Further, as it taught in U.S. Pat No. 4,955,756, subterranean pipelines are frequently supported above the trench floor by spaced (i.e., approximately every 15 feet) small piles of sand bags or the like, thereby allowing the padding machine to deposit padding material under, on the sides of, and over the newly laid pipe. There are occasions, however, where such support means may be unfit for practical use. This may be the case, for example, when the wall thickness of the steel or plastic pipe is relatively thin (thin walled pipe). In this situation, intermittent support of thin walled pipe may result, due to the pipe's own dead weight, in a slight flattening or egg shaping of the pipe at the individual support sites. A desirable alternative would be to provide a continuous bed layer of fine grained fill material which affords uniform, non-injurious pipe support throughout its length.

In this connection, the backfill apparatus of U.S. Pat. No. 4,955,756 is not readily usable for laying a trench bed layer consisting solely of fine grained material. This is because the unclassified backfill is separated by size and laid by the machine such that the finest materials would be placed first, i.e., on the floor of the trench, with progressively coarser materials being placed atop the fines. From a practical perspective, this means the pipe being laid would be directly supported by the coarsest fraction laid by the apparatus. Thus, if the pipe is one which is coated with a corrosion resistant material, such coating is apt to be scratched or damaged by the coarse grains which, in turn, may facilitate corrosive activity and, possibly, premature failure of the pipe.

U.S. Pat. No. 4,861,461 describes another apparatus for laying a padding layer of fine grained backfill material in a pipeline trench. The apparatus includes a frame which carries a storage hopper for receiving unclassified backfill material and a first conveyor for delivering the backfill material from the hopper to a double-deck vibrating screen for separating fine particulate matter (to be used as a pipeline bedding layer) from coarser fractions of the unclassified backfill material, which coarser fractions are discharged from the apparatus via a second conveyor. In addition, the apparatus carries a third extendable and retractable conveyor for delivering to the pipeline trench the fines which pass the vibrating screen. In operation, the apparatus extends generally transverse to the trench and is vehicle-drawn or self-propelled generally parallel to the trench, whereby the third conveyor delivers the fines to the trench.

Although the apparatus is capable of laying a trench bed layer consisting of fine grained material derived from unclassified fill material, it is quite complex in construction. Furthermore, it has inherent limitations as to its operability in environments where local topography adjacent the trench is highly varied, particularly in elevation. That is to say, the height at which the fines conveyor is suspended above the ground is fixed and minor adjustments to its attitude are achieved by selective operation of short-throw hydraulic cylinders which pivot a turntable frame that carries the fines conveyor. Thus, the pipeline padding machine of U.S. Pat. No. 4,861,461 may be rendered essentially ineffective in situations where topography sharply rises or falls.

An advantage exists, therefore, for a trench backfill apparatus of uncomplicated construction that can lay a bed layer consisting of fine grained material derived from unclassified fill material, which apparatus would be operable to fill a trench without requiring its suspension thereover and be capable of functioning effectively in environments having highly varied local topography.

SUMMARY OF THE INVENTION

The present invention provides apparatus for laying a trench bed layer consisting of fine grained material derived from unclassified fill material. The system includes a main frame that is pivotally supported by a hitch means carried by the tool arms of a front end loader. The hitch means include a support bar that extends as a cantilevered beam in the direction of travel of the front end loader whereby the main frame is securable to the support bar so as to extend transverse to the travel direction of the front end loader. Hydraulic cylinders normally used for manipulating the tool arms of the front end loader vary the attitude or angle of attack of the main frame in accordance with ground slope. The hitch means also carries means for pivoting the main frame about a pin connection joining the main frame and the support bar.

The apparatus further includes a storage hopper carried by the main frame into which unclassified backfill material is loaded. The storage hopper mouth is preferably provided with a grizzly to preclude large rock and oversize masses of clay fill from entering the hopper. An upwardly inclined, longitudinally extending (in relation to the main frame) conveyor transports the fill material from the bottom of the hopper to a higher elevation whereupon the fill is discharged from the conveyor and preferably passes through a comminuting station before falling onto a downwardly inclined, laterally extending (in relation to the main frame) vibrating screen. The speed of the conveyor may be varied to adjust the flow of backfill onto the vibrating screen to allow for varying backfill consistencies, moisture content, padding and bedding material size specifications and the like. Additionally, the attitude of the apparatus may be adjusted so as to compensate for changes in right-of-way elevation, i.e., uphill, downhill and side hill conditions. Still further, the screen is preferably double-decked with the upper screen element being of a coarser mesh than the lower screen element.

A second longitudinally extendable and retractable bedding (fines) conveyor is situated beneath the vibrating screen and receives only the fine particulate fraction of the original unclassified fill material which is sufficiently small to pass through the lower screen element. That fraction of the fill material which fails to pass the sloped vibrating screen is discharged by gravity from a chute portion at an open-walled lower end of the screen. The extendable and retractable conveyor may be translated by a suitable expansible drive means such as hydraulic cylinders, or the like, whose stroke length may be but is not required to be sufficient to traverse the width of the pipeline trench to be backfilled. The primary purpose of the extensibility and retractability of the fines conveyor is to allow the operator to "fine-tune" material discharge adjustments to deliver the bedding or padding material at an ideal location, independently of the loader location. Hence, as the front end loader moves generally parallel to the trench, the second conveyor may be translated inwardly and outwardly, as necessary, relative to the main frame so as to discharge a pipeline bed layer to the floor of the trench sufficient to pad the subsequently laid pipeline. In the generally preferred construction, the second conveyor is translated by hydraulic cylinders having a stroke length of approximately three feet. The cylinders can be attached to selected positions along the second conveyor to affect extensions of the second conveyor from the main frame of up to eight feet or more so as to accommodate variations in trench linearity. The present invention is also particularly applicable to laying padding material around and atop the pipeline once it is laid.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
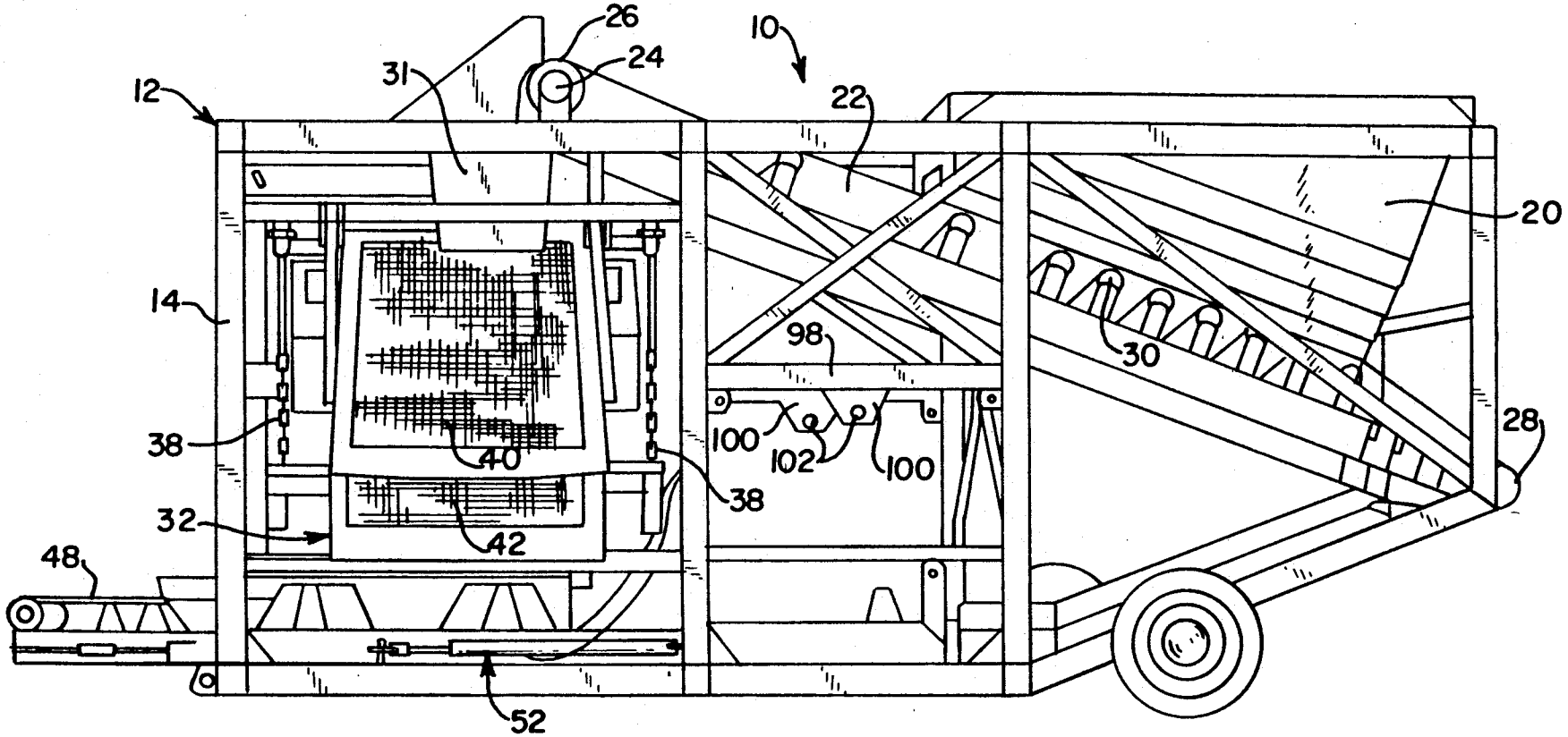
FIG. 1 is a side elevation view of a preferred embodiment of a backfilling apparatus adapted for use in the backfilling system of the present invention.
Figure 2:
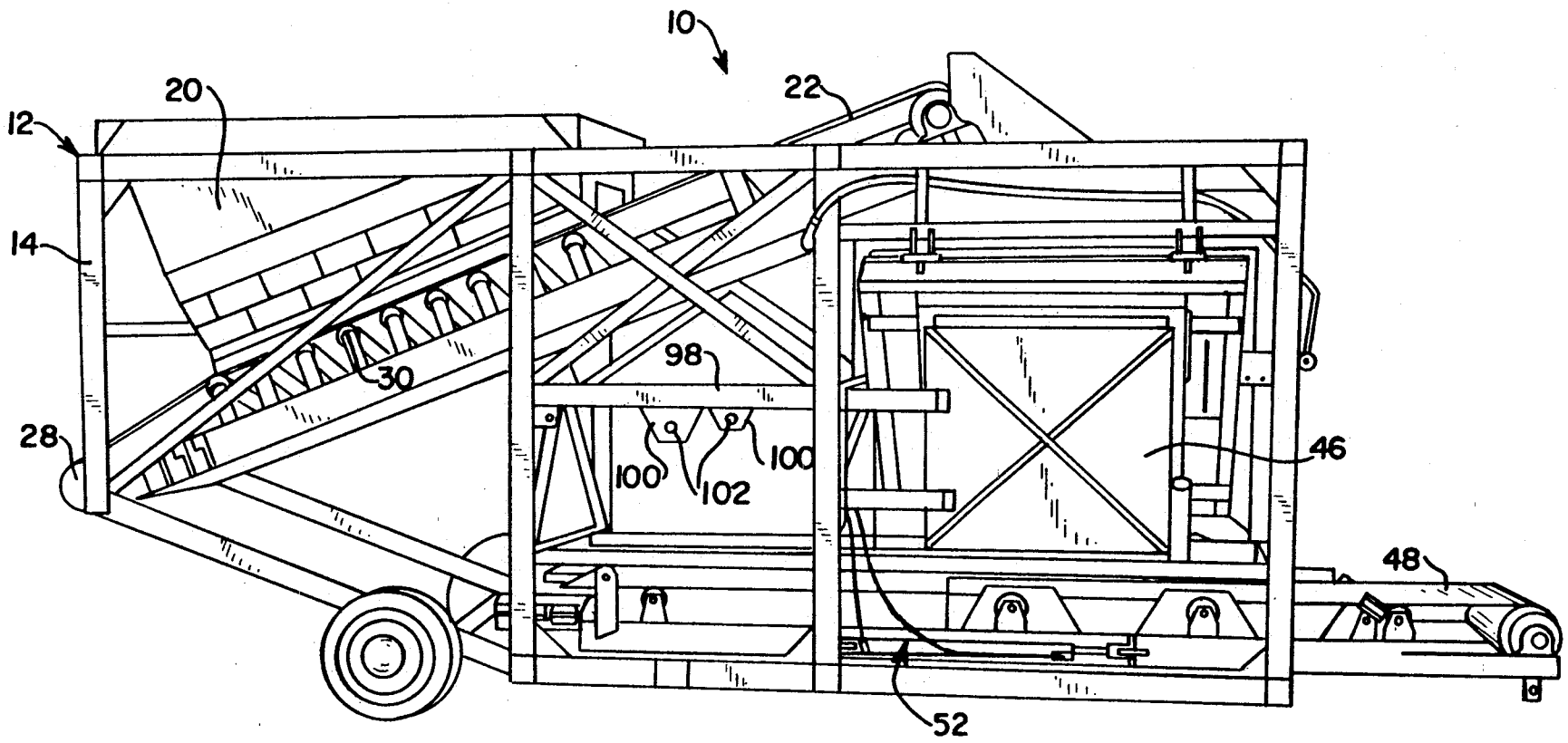
FIG. 2 is a view of the opposite side of the backfilling apparatus of FIG. 1.
Figure 3:
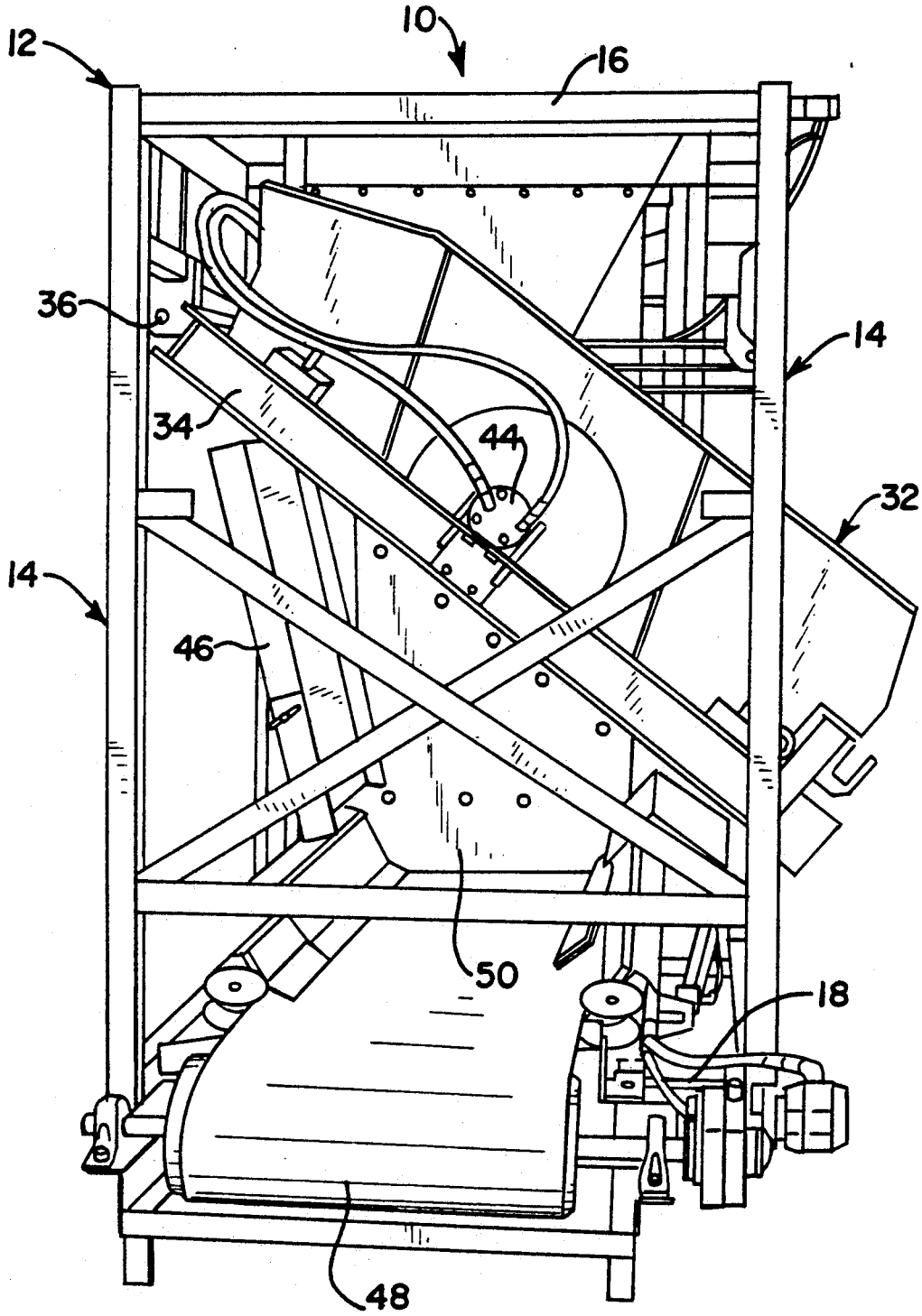
FIG. 3 is an end elevation view of the backfilling apparatus of FIG. 1.

As illustrated in FIGS. 1-3, the pipeline padding system according to the present invention comprises a backfilling apparatus, herein designated by reference numeral 10. The backfilling apparatus includes a main frame 12 including two substantially identical vertically extending side truss portions 14 joined by a plurality of upper and lower transversely extending cross beams 16 and 18, respectively. Supported within an upper portion of the main frame 12 generally proximate a first end thereof is a storage hopper 20 having an upwardly open mouth. Preferably, a grizzly (not illustrated) similar to that described in U.S. Pat. No. 4,955,756 is pivotally attached to an edge of the mouth of the hopper. The grizzly precludes oversize fill material from entering the hopper. That is, oversize material slides off the grizzly and falls to the side of machine. If, however, any oversize material, such as wet clay clumps or the like, would stick to or between the grizzly bars, the grizzly may be conveniently evacuated of such material by upward tilting thereof through operation of a suitable actuator such as a hydraulic cylinder or the like.

Situated beneath the hopper and extending in the longitudinal direction of the main frame is a first upwardly inclined continuous belt conveyor 22 driven by a motor 24 coupled to a conveyor head pulley 26. At the end of the first conveyor opposite the conveyor drive roll is a tail pulley 28 with take-up bearings for belt tracking and tensioning as is known in the art and between these rolls is a plurality of belt idlers 30. The upper run of the belt conveyor essentially forms the bottom of the hopper 20 and carries fill material from the hopper upwardly to a point whereat the belt passes around the head pulley 26 such that the fill material falls onto a chute 31 which breaks the fall and spreads the material onto a vibrating screen 32.

The vibrating screen 32 is downwardly inclined and extends transverse to the longitudinal direction of the main frame 12. The screen includes a frame 34 that is pivotally connected at an upper end thereof to one truss portion of the main frame (as is represented by reference numeral 36 in FIG. 3) and at its lower end is suspended by a plurality of adjustable supports 38 (FIG. 1) attached to the other truss portion, whereby adjustment of the supports 38 establishes the inclination of the screen 32.

If desired, the upper portion of the vibrating screen may be provided with a power driven comminuting or shredding station for pulverizing the fill material discharged from the first conveyor prior to its landing upon the vibrating screen.

Although the vibrating screen may comprise a single screen element, it is preferred that the screen be double-decked wherein the upper deck screen element 40 has larger grid or mesh apertures than the lower deck screen element 42. A motorized vibrator 44, preferably an eccentric shaft vibrator, is carried by the screen frame and imparts vibration to the screen elements. An eccentric shaft vibrator is preferred since it agitates the screen in an orbital rather than a reciprocating motion and its amplitude of motion is not dampened or reduced under loaded conditions.

The smallest particles of fill material which pass both the upper deck and lower deck screen elements of the screen drop onto a second motorized belt conveyor (to be described in greater detail herebelow) whereby they are transported and discharged into a trench to provide a bed layer for a subsequently laid pipeline. Those fill material particles too large to pass screen element 40 and/or screen element 42 travel down the surfaces of these screen elements under the influence of gravity and fall through chutes at the lower open end of the screen onto the surface of the ground adjacent the trench to be later disposed of as desired, e.g., for use as trench backfill once the pipeline is adequately padded by fine grained padding material. FIGS. 2 and 3 reveal that the backfilling apparatus 10 is also preferably provided with an elongated, steeply inclined chute 46 attached to one side truss portion 14. The chute 46 serves to contain within the confines of the main frame the backfill material which passes screen 32 and to guide same onto the second conveyor, designated herein as reference 48. It is also desirable that a generally transversely extending shroud 50 (FIG. 3) be provided immediately upstream of the screen 32 for the similar purpose of containing and guiding the particles which pass the screen.

Figure 4:
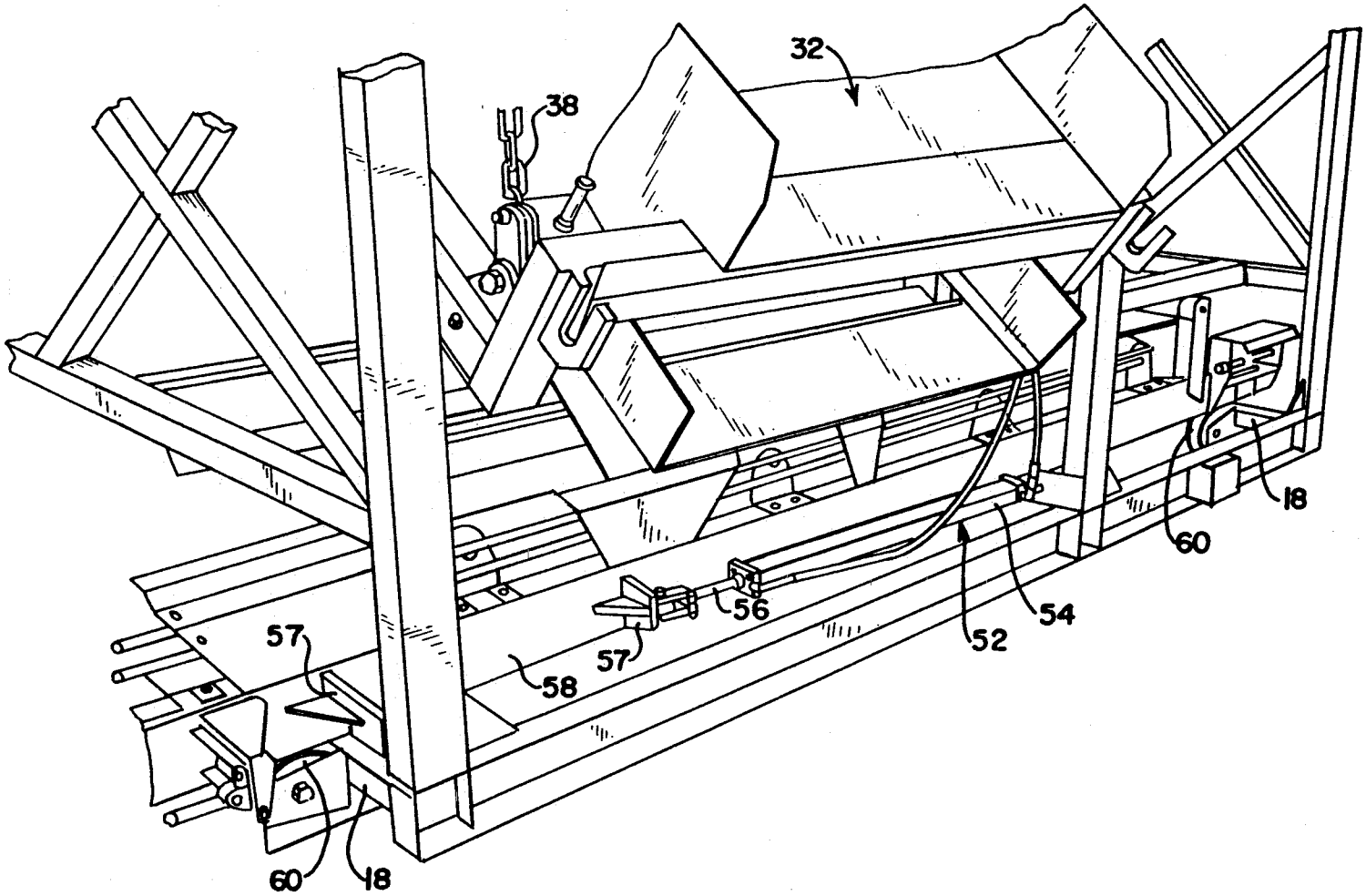
FIG. 4 is an enlarged perspective view of a portion of the backfilling apparatus of FIG. 1.
Figure 5:
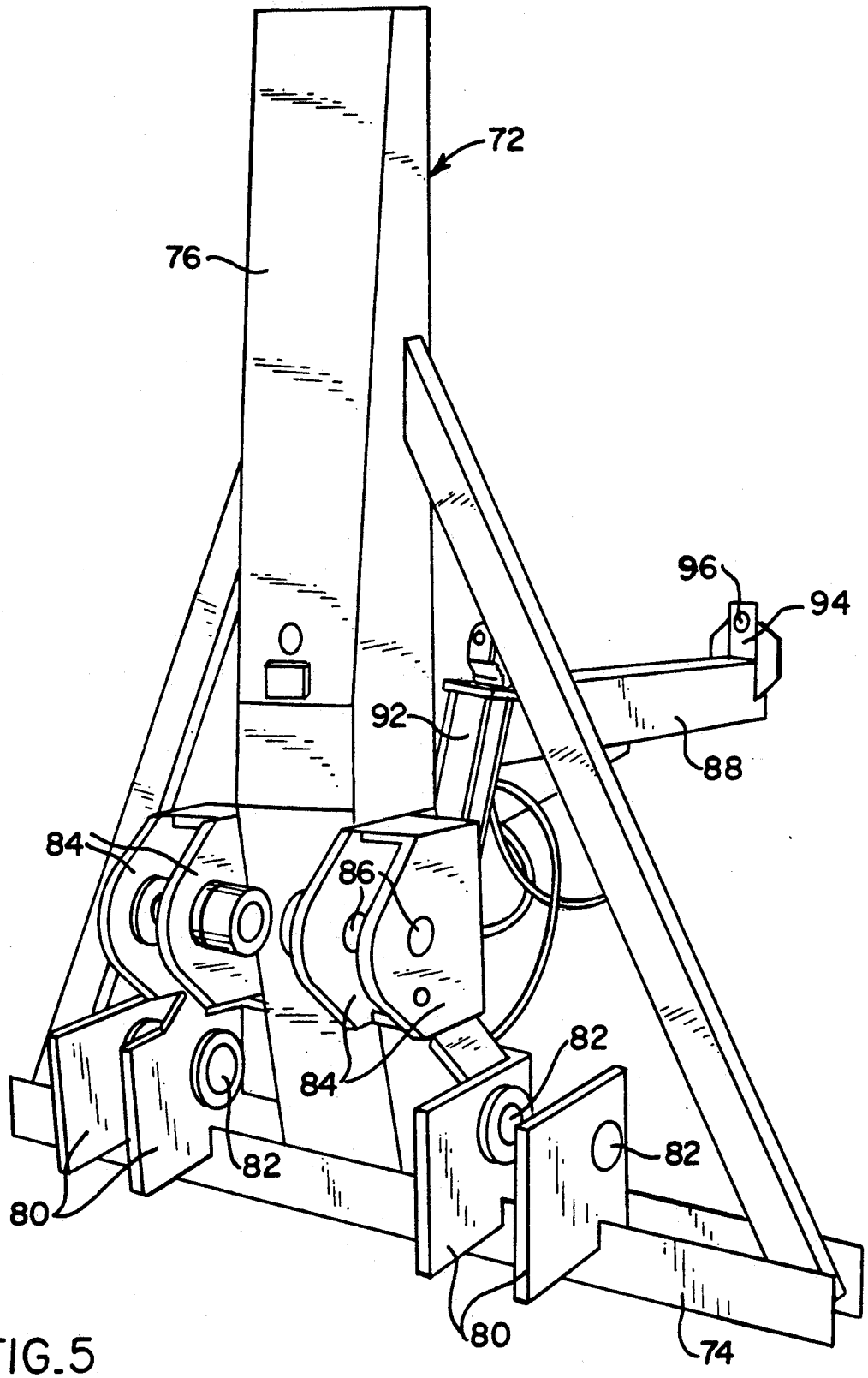
FIG. 5 is a rear perspective view of a preferred embodiment of hitch device adapted for use in the backfilling system of the present invention.
Figure 6:
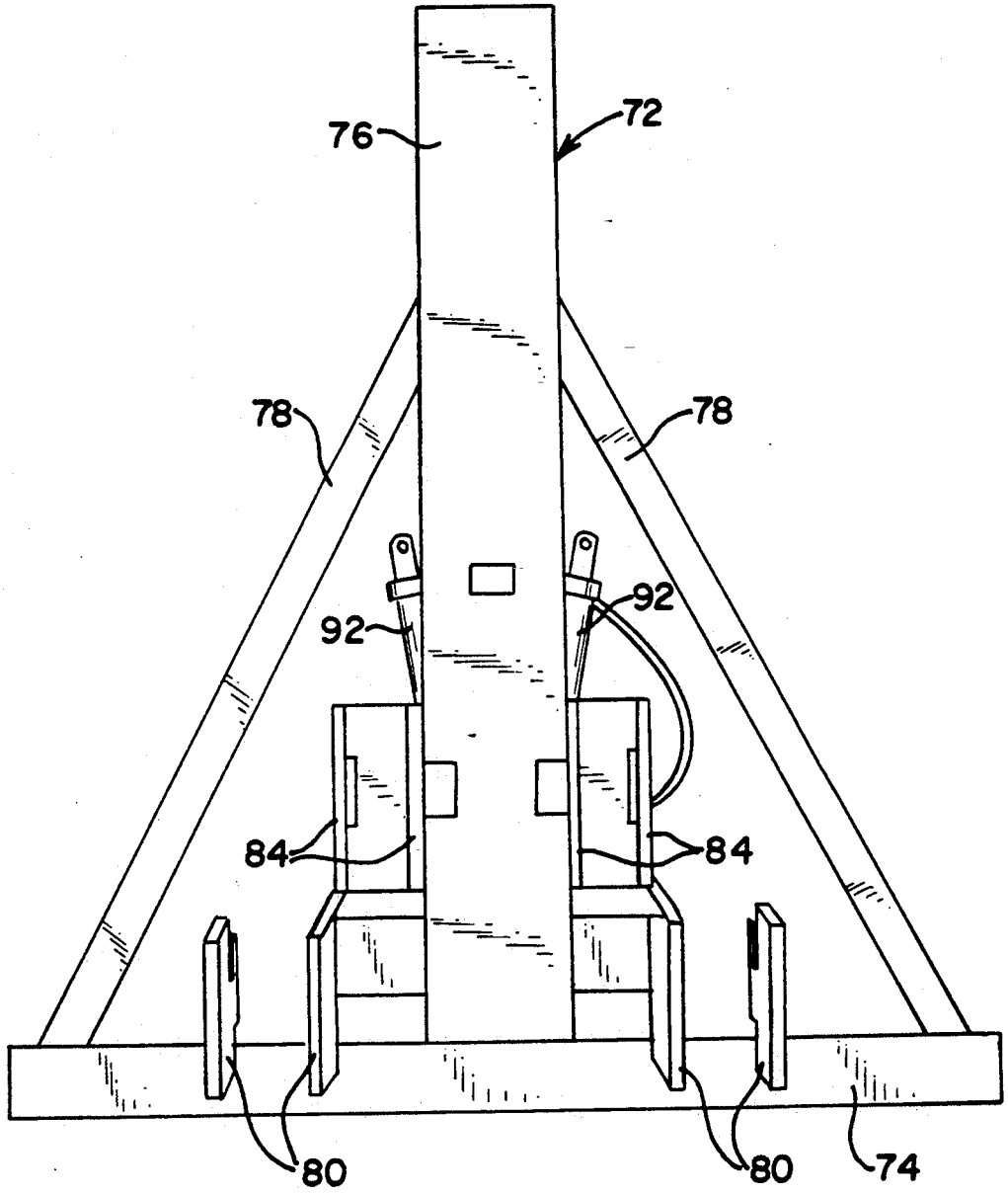
FIG. 6 is a rear elevation view of the hitch device of FIG. 5.
Figure 7:
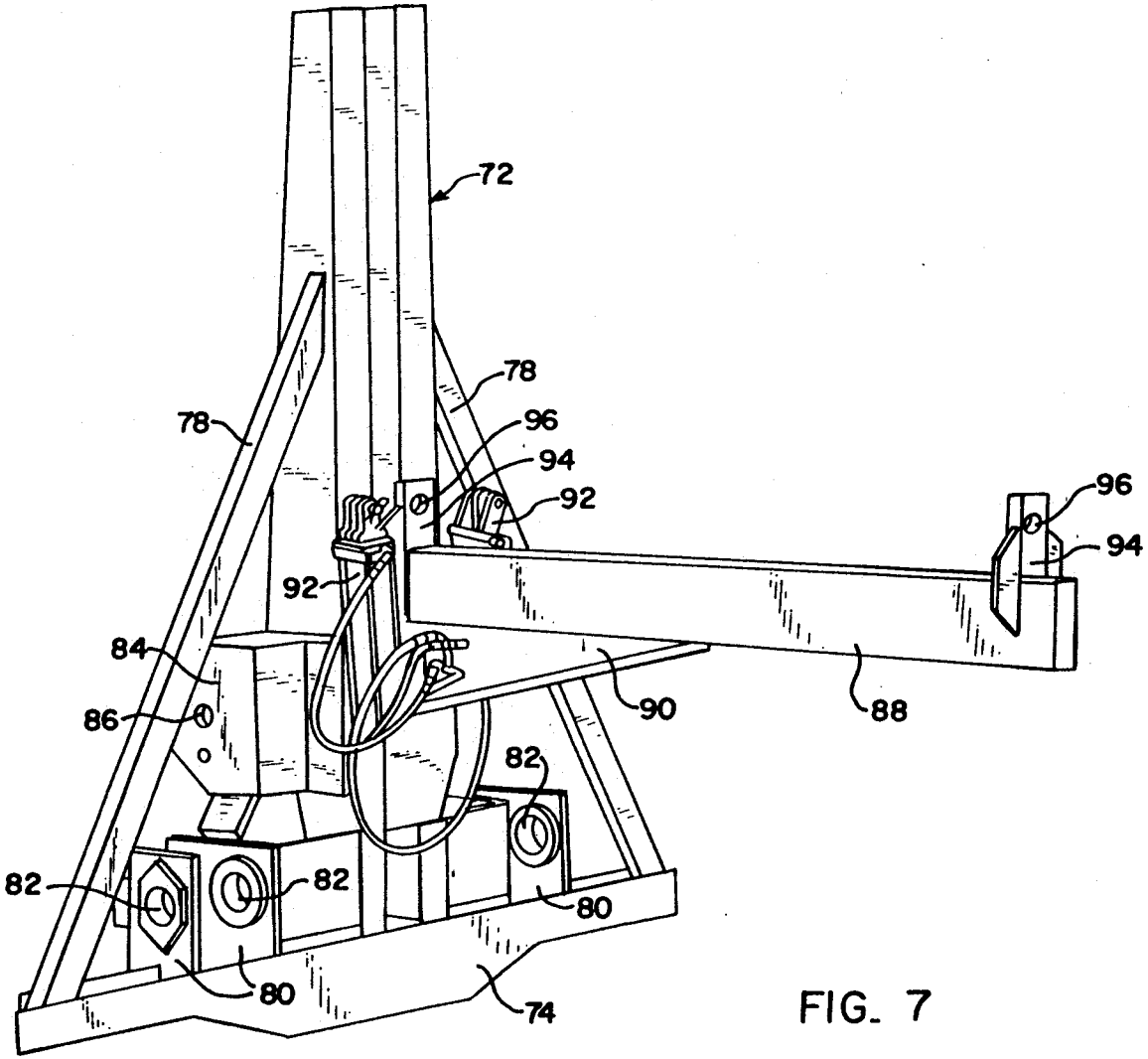
FIG. 7 is a front perspective view of the hitch device of FIG. 5.

The second conveyor 48 (which includes a head pulley, tail pulley and idlers similar to conveyor 22) is supported in a lower region and extends longitudinally of the main frame 12. Suitable actuating means 52 are preferably provided on opposite sides of the second conveyor for translating, particularly extending and retracting, the second conveyor relative to the main frame. In a presently preferred construction, and as can be best appreciated by reference to FIG. 4, these actuating means preferably comprise hydraulic actuators having their cylinders 54 connected to lower frame members of the side truss portions and their pistons 56 releasably connected to spaced apart gussets 57 attached to side rails 58 of a support frame of the second conveyor. To facilitate translation of the second conveyor relative to the main frame, cross beams 18 joining the lowermost frame members of the side truss portions 14 are provided with freely rotatable support wheels 60 which support the bottoms of the second conveyor support frame side rails 58.

It is preferred that the stroke length of the hydraulic actuators 52 be approximately three feet. Moreover, the gussets 57 are preferably spaced at sufficient distances from one another along the second conveyor side rails 58 whereby the pistons 56 may be connected to selected pairs of the gussets to achieve extensions of the second conveyor from the main frame of up to eight feet or more. Alternatively, gussets 57 may be provided on main frame 12 instead of the second conveyor means whereby the actuators 52 may be releasably connected to the main frame rather than the second conveyor means. As a result of such a construction, variations in trench linearity are easily accommodated. In addition, the main frame and its transport vehicle (to be described in greater detail hereinafter) may be operated at a safe distance from the trench when soil conditions immediately adjacent the trench do not permit heavy equipment traffic thereover. It will be appreciated that other suitable means may be used to extend and retract the second conveyor means such as, for example, pneumatic cylinders, motorized screw jacks, or the like.

Figure 8:
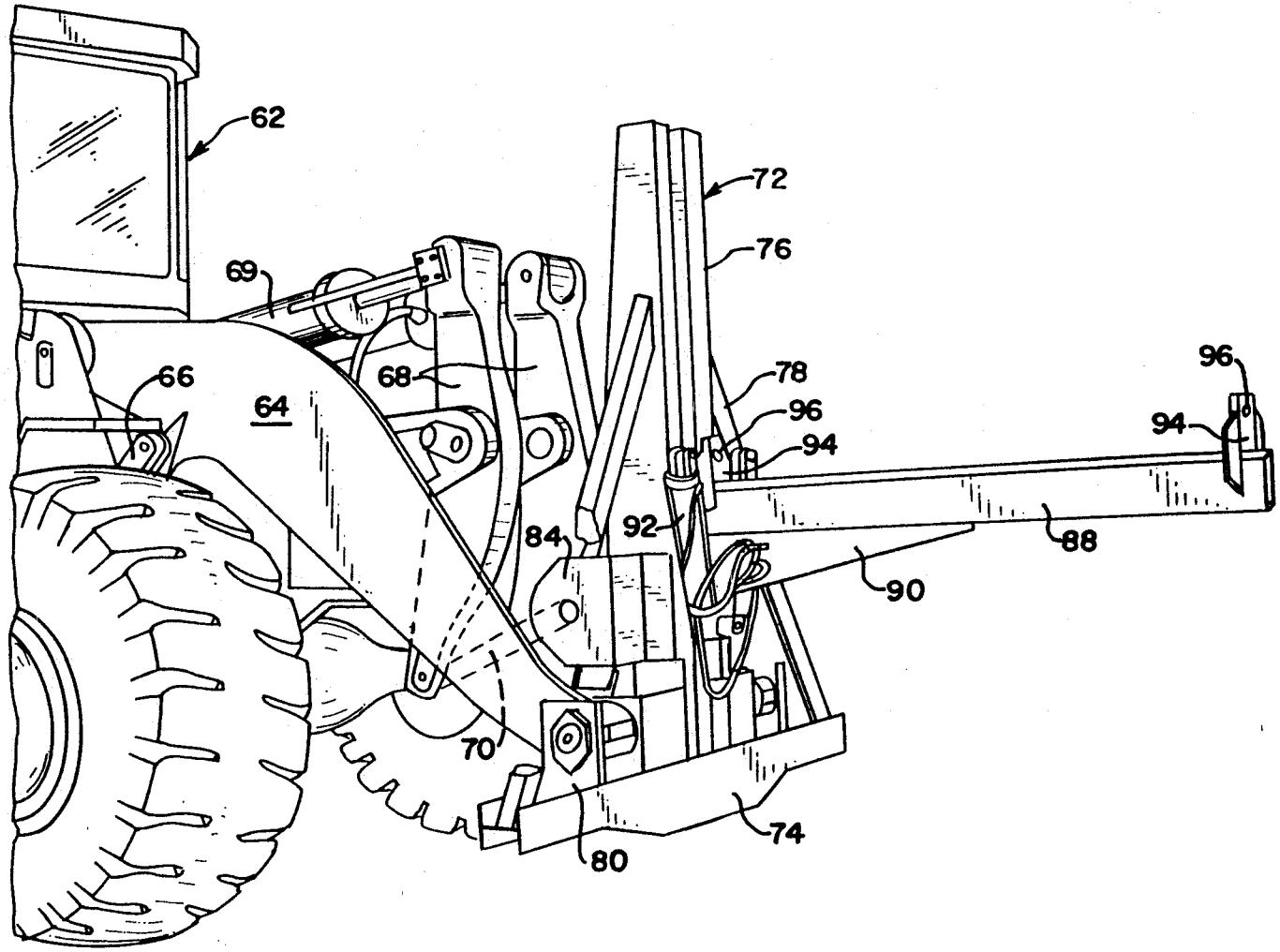
FIG. 8 is a perspective, partially cut view of the hitch device of FIG. 5 attached to a front end loader.
Figure 9:
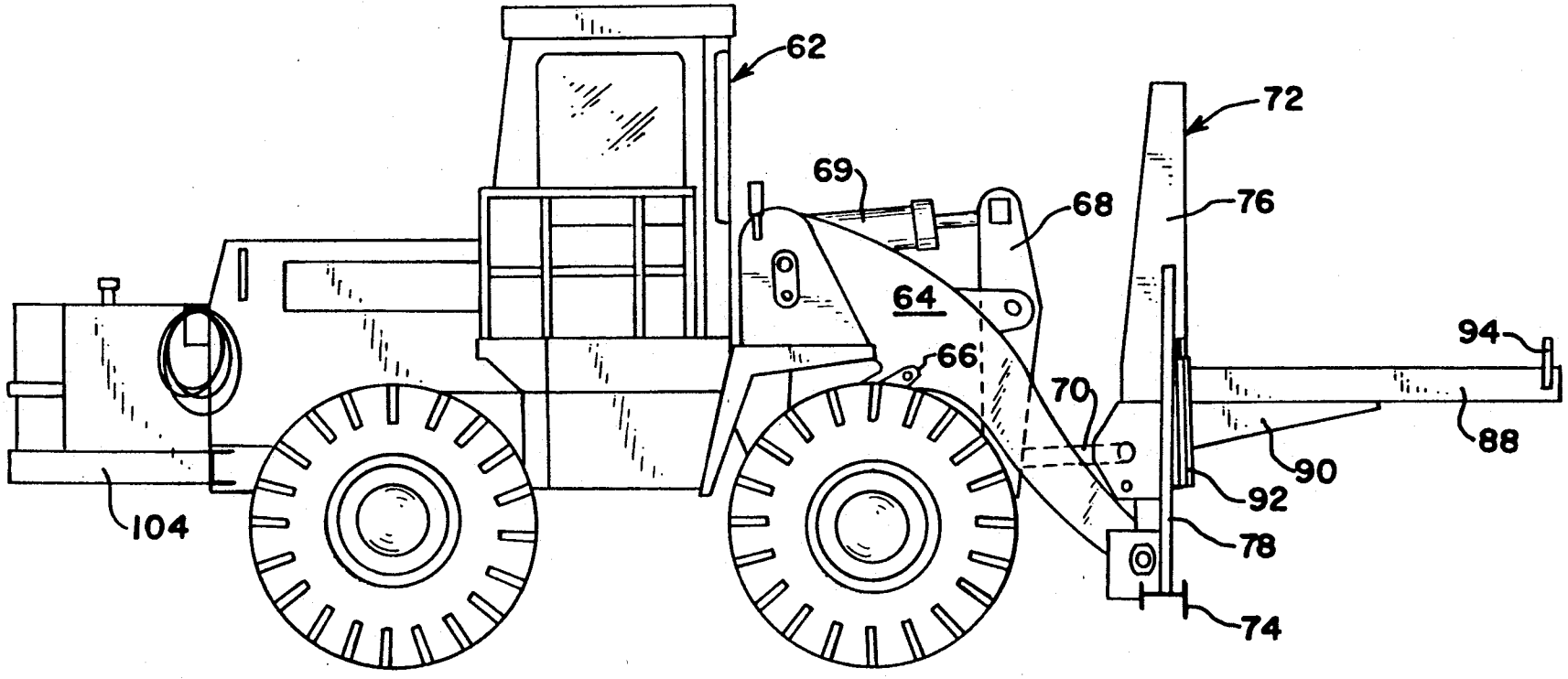
FIG. 9 is a side view of the front end loader with the hitch device of FIG. 5 attached at one end thereof and a backfilling apparatus power source platform attached to the opposite end thereof.
Figure 10:
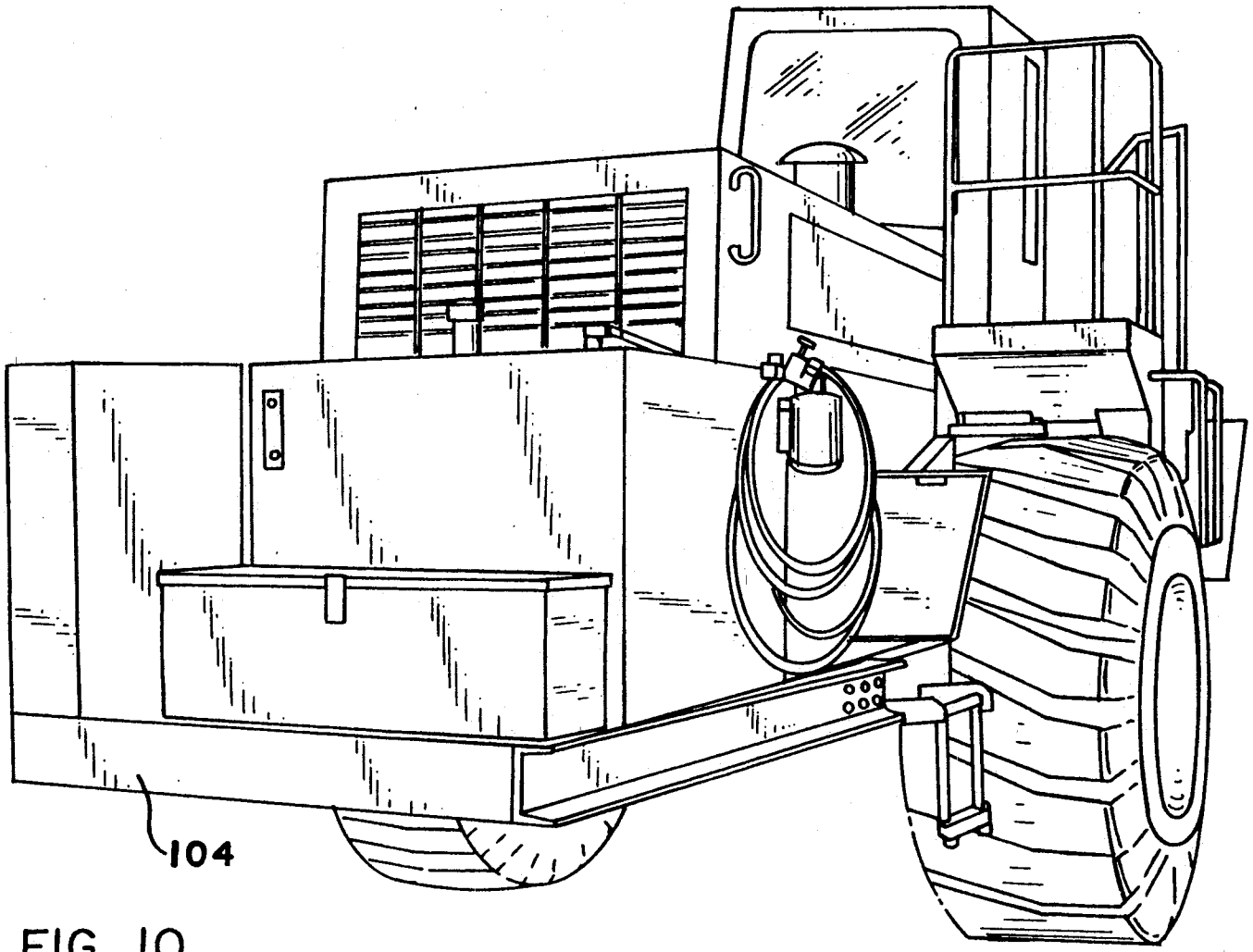
FIG. 10 is a perspective view of the backfilling apparatus power source platform attached to a front end loader.

Turning to FIGS. 8 and 9, there is shown a side view of a front end loader 62 which, as is typical, includes a pair of lifting arms 64 pivotally attached to the chassis of the front end loader that are raised and lowered by hydraulic cylinders 66. A pair of rocker arms 68 are carried by and pivotally attached to the lifting arms. The upper ends of the rocker arms are connected to hydraulic cylinders 69 which are also carried by the lifting arms and the lower ends of the rocker arms are pivotally connected to links 70 which, along with the distal ends of the lifting arms, are typically attachable to equipment to be manipulated by the front end loader.

In accordance with the present invention, the pipeline padding system of the present invention includes a hitch device 72 that is adapted for connection to the lifting arms 64 and links 70 of the front end loader 62 and is constructed to pivotally support the main frame 12 of the backfilling apparatus 10. The details of the hitch device will be appreciated by reference to FIGS. 5-9.

The hitch device 72 according to the invention preferably comprises a horizontal base beam 74 and an upwardly extending mast 76 which is preferably laterally supported by diagonal braces 78. A first set of clevis means is integrally fixed to the horizontal beam. The first set of clevis means includes two pairs of plates 80, one pair being disposed on each side of the vertical mast, wherein each pair includes aligned holes 82 for receiving a pin for pivotally fastening the plates 80 to the distal end of a respective one of the lifting arms 64. Similarly, a second set of clevis means is affixed to the vertical mast. The second set of clevis means also includes two pairs of plates 84, situated on opposite sides of the mast, wherein each pair includes aligned holes 86 for receiving a pin for pivotally fastening the plates 84 to a respective one of the links 70 that are connected to the rocker arms 68 of the front end loader.

Projecting from the vertical mast 76 is a cantilever support bar 88 that is desirably reinforced at its underside with gusset plates 90. Positioned on each side of the support bar adjacent the vertical mast is a hydraulic cylinder 92, the function of which will be described in greater detail hereinafter. Extending upwardly from opposite ends of the support bar are connection plates 94 having bores 96 provided therein. Additional connection plates 94 may be provided along support bar 88, as necessary, to accommodate backfilling apparatus of variable widths.

Figure 11:
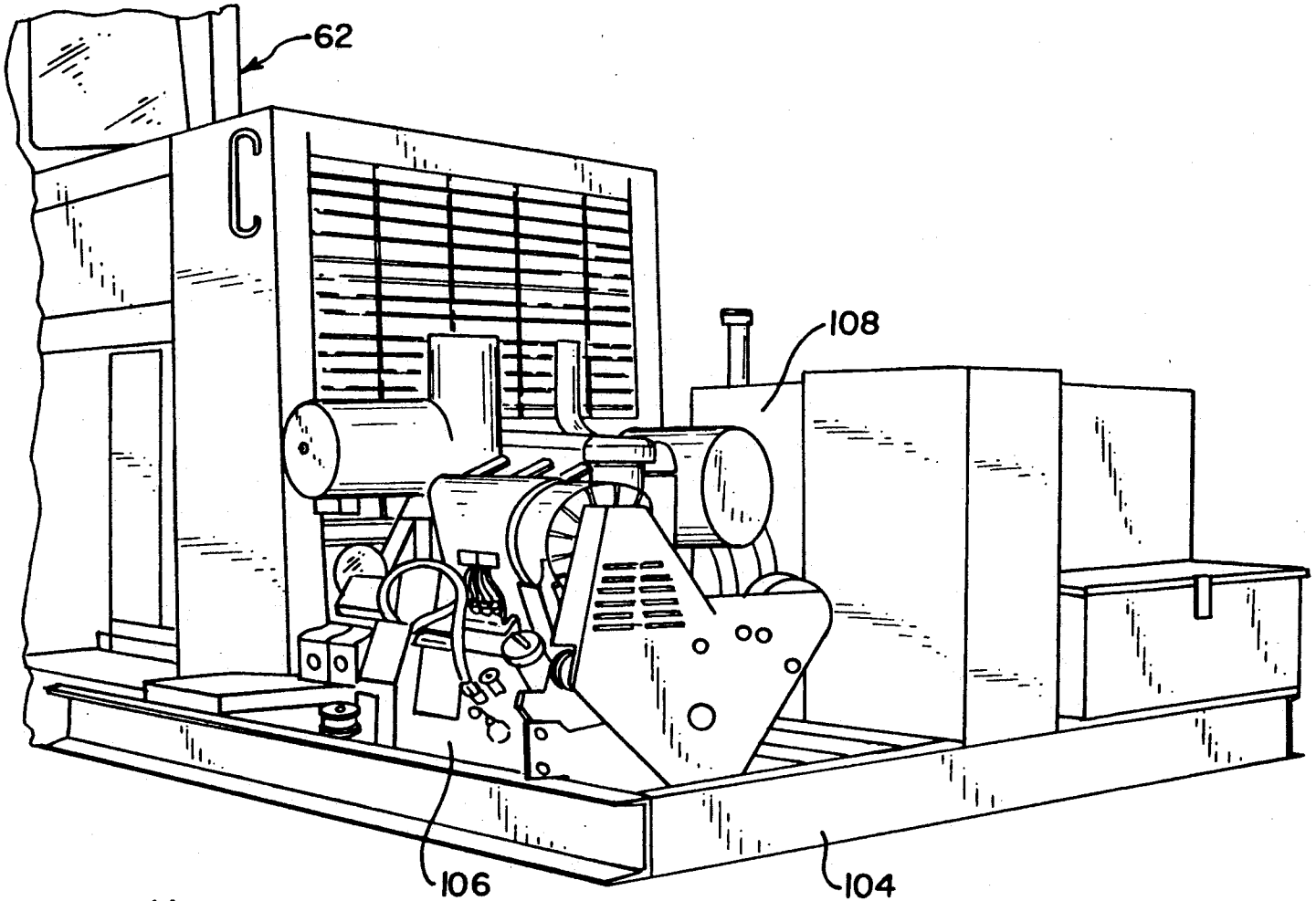
FIG. 11 is a perspective view similar to FIG. 10 depicting the opposite side of the backfilling apparatus power source platform.

Turning once again to FIGS. 1 and 2, it will be seen that the illustrated side truss portions of the main frame include a generally centrally located horizontal brace member 98 from which depends a connection plate 100 having a bore 102 therethrough. To mount the main frame 12 to the hitch device 72 as in the manner depicted in FIG. 12, the support bar 88 is inserted transversely through the main frame beneath the brace members 96, the plates 94 and 100 are brought into alignment and the aligned bores 96, 102 are joined by suitable pin means. Thereafter, the hydraulic cylinders 92 on opposite sides of the support bar 88 are connected to the brace member 98 closest to the vertical mast 76 of the hitch device. At the opposite end of the front end loader there is affixed a backfilling apparatus power source platform 104 (FIGS. 9–13) which supports appropriate hydraulic system drive equipment. FIG. 11 in particular shows that such equipment includes an internal combustion engine 106, a hydraulic oil tank 108 and other related equipment, which supplies pressurized hydraulic oil through suitable hoses to the various motors and extensible actuators of the pipe padding system of the present invention thus far described. Although hydraulic means are preferred for driving the motors and actuators of the present invention, it will be appreciated that other suitable motive sources such as, for example, electric and pneumatic means may instead be employed.

Figure 12:
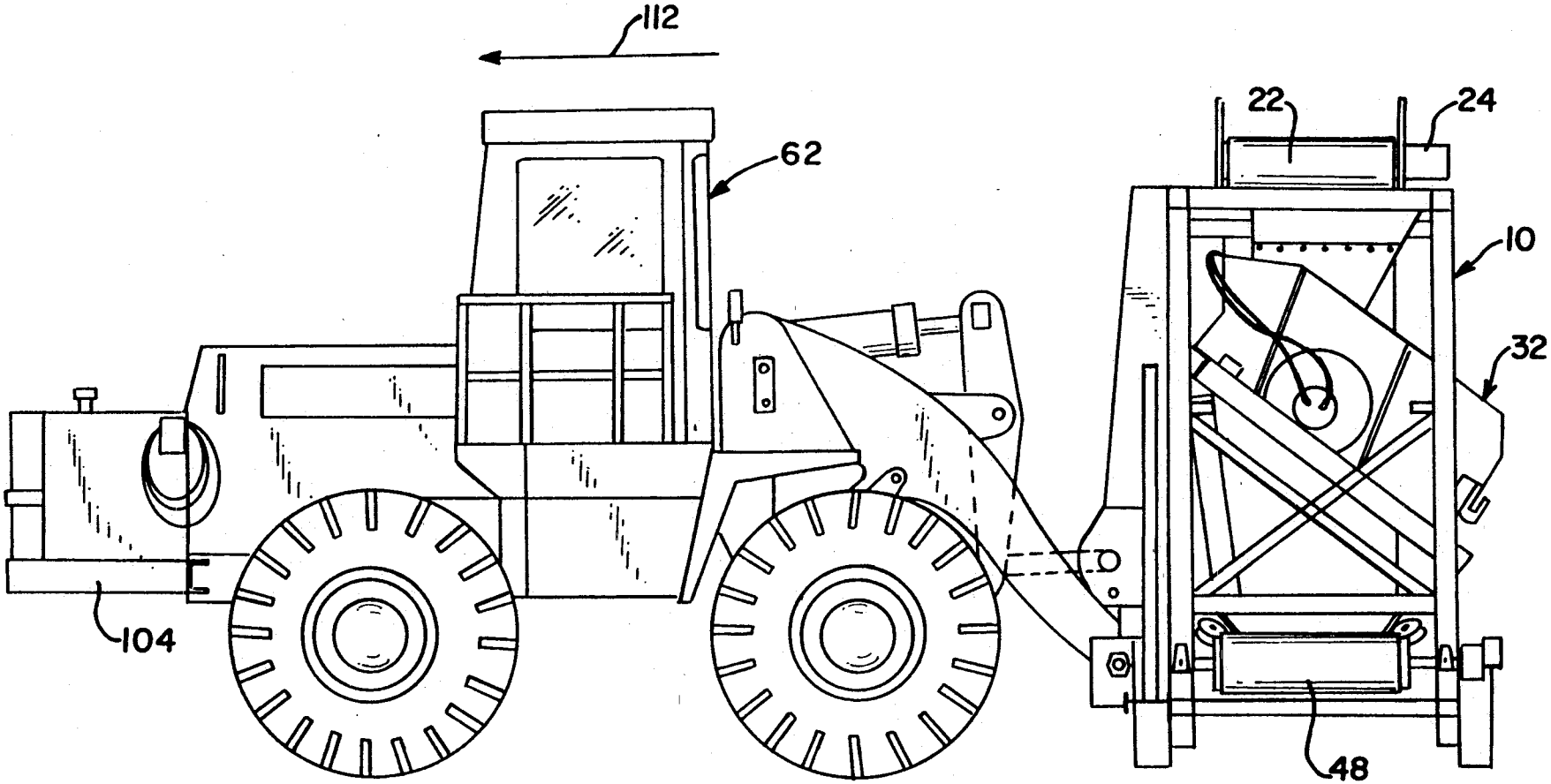
FIG. 12 is a view similar to FIG. 9 showing the backfilling apparatus supported by the hitch device.
Figure 13:
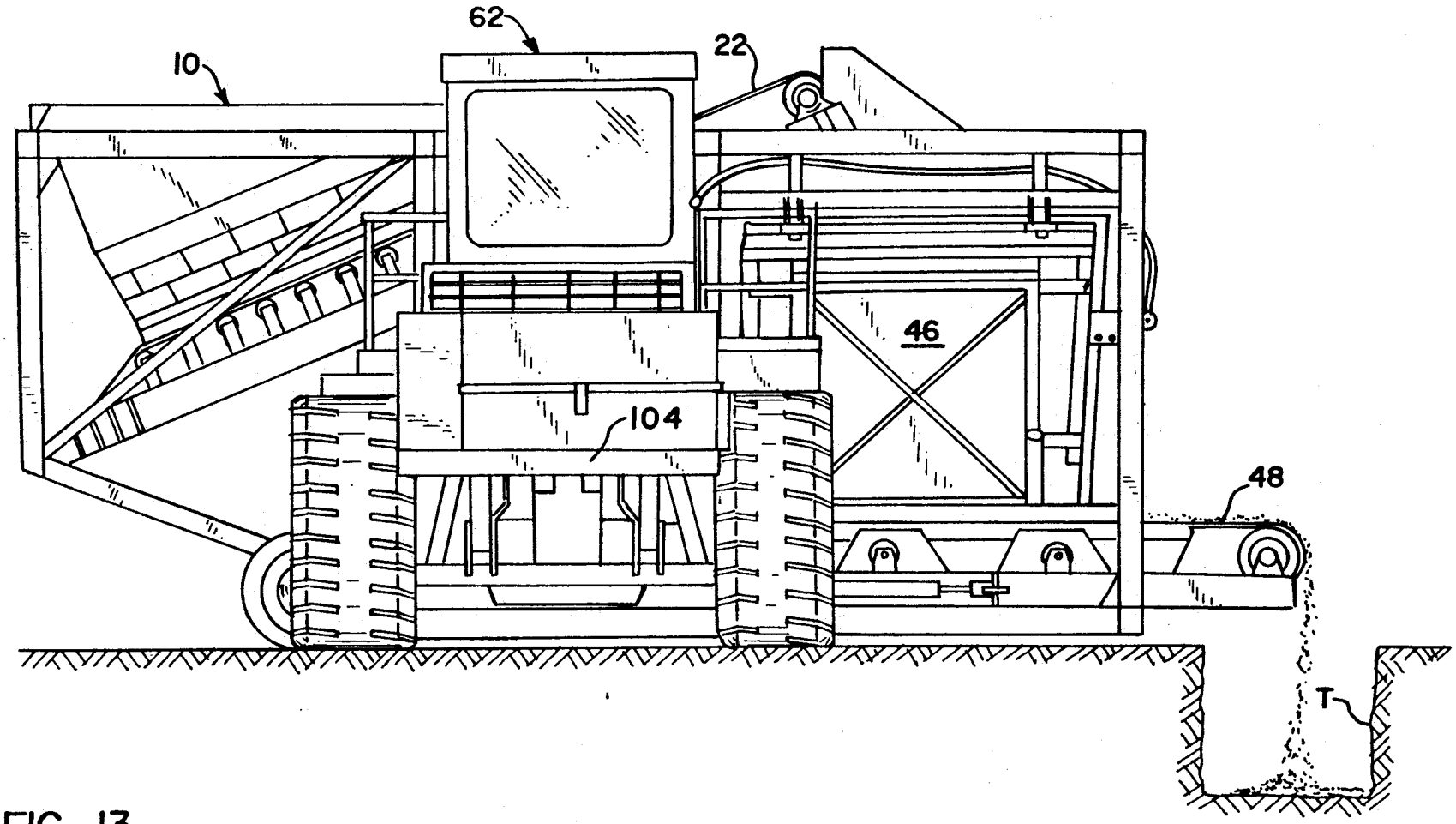
FIG. 13 is a view of the backfilling system of the present invention in operation when filling a trench.

FIGS. 12 and 13 depict the pipeline padding system of the present invention as it would appear when delivering to the floor of a trench T a bed layer of fine grained fill material. As the front end loader travels in the direction of arrow 112 in FIG. 12 and "out" of the page toward the reader in FIG. 13, unclassified material contained in the storage hopper 20 is carried therefrom by the first conveyor 22 whereupon it is dropped through chute 31 onto the downwardly inclined vibrating screen 32. From there, the grains of fill material small enough to pass the screen drop onto the second conveyor 48 which deposits the fine grained material onto the trench floor. The degree of extension of conveyor 48 from main frame 12 is continuously controlled whereby the discharge therefrom is caused to fall generally along the centerline of the trench T. If desired or necessary, a small earthworking device may be passed through the trench to smooth and level the padding layer laid therein by backfilling apparatus 10. This effect can be simply achieved by appropriate manipulation of actuators 52 as the front end loader progresses adjacent the trench. As mentioned hereinabove, the fraction of the fill material that is too large to pass through the screen simply falls from the lower open walled end of the screen, thereby forming a deposit which trails the backfilling apparatus 10 as it progresses alongside the trench. This deposit may be later used as backfill to cover the pipeline (not illustrated) once it has been laid in the trench and covered by a layer of fine grained material deposited by a second pass of the backfilling apparatus.

Through suitable operator controls the speeds of the conveyors 22 and 48, the elevation and the angle of attack, i.e., attitude, of the backfilling apparatus may be readily adjusted during operation. For example, should ground slope either rise or fall, even relatively sharply, the positions of the lifting arms 64 and rocker arms 68 of the front end loader can be easily changed to accommodate such geographical variations. In addition, the cylinders 92 adjacent the hitch support bar can be operated to selectively pivot the main frame generally about the hitch support bar 88 and the actuators 52 may be activated, as necessary, to extend and retract the second conveyor 48 to thereby accommodate variations in the linearity of the trench.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. Apparatus for delivering backfill material to a trench, said apparatus comprising:

a main frame carrying a storage hopper, a vibrating screen and first conveyor means for transporting backfill material from said hopper to said vibrating screen;

second conveyor means carried by said main frame for transporting to said trench particles of said backfill material which pass said vibrating screen; and hitch means for connecting said main frame to a vehicle having a pair of lift arms, means for raising and lowering said lift arms, a pair of rocker arms pivotally connected to said lift arms, means connected to first ends of said rocker arms for moving said rocker arms relative to said lift arms, and links connected to second ends of said rocker arms, said hitch means including first means for attaching said hitch means to said lift arms and second means for attaching said hitch means to said links, whereby said means connected to said first ends of said rocker arms are operable to adjust the attitude of said main frame and said means for raising and lowering said lift arms are operable to adjust the elevation of said main frame when said main frame is attached to said hitch means.

2. The apparatus of claim 1 wherein said particles which pass said vibrating screen are of a size sufficient to serve as pipeline padding material.

3. The apparatus of claim 1 wherein said first conveyor means and second conveyor means extend substantially longitudinally of said main frame and said vibrating screen extends substantially transverse to said main frame.

4. The apparatus of claim 1 further comprising means for translating said second conveyor means relative to said main frame.

5. The apparatus of claim 4 wherein said means for translating comprise extendable and retractable actuators connected to said main frame and said second conveyor means.

6. The apparatus of claim 5 further comprising means for enabling releasable connection of said extendable and retractable actuators to a plurality of sites along one of said main frame and said second conveyor means.

7. The apparatus of claim 1 wherein said hitch means further includes a support bar, means for pivotally connecting said main frame to said support bar and means for pivoting said main frame relative to said hitch means.

8. The apparatus of claim 1 wherein said vehicle is a front end loader.

* * * * *